US006575564B1

(12) United States Patent
Tsuchiya et al.

(10) Patent No.: US 6,575,564 B1
(45) Date of Patent: Jun. 10, 2003

(54) INK JET RECORDING METHOD USING HIGH VISCOUS SUBSTANCE AND APPARATUS FOR CARRYING OUT THE SAME

(75) Inventors: Katsunori Tsuchiya, Shinjuku-Ku (JP); Masato Okabe, Shinjuku-Ku (JP)

(73) Assignee: Dai Nippon Printing Co., Ltd. (JP)

( * ) Notice: Subject to any disclaimer, the term of this patent is extended or adjusted under 35 U.S.C. 154(b) by 0 days.

(21) Appl. No.: 09/407,999

(22) Filed: Sep. 29, 1999

(30) Foreign Application Priority Data

Sep. 30, 1998 (JP) ..... 10-278141
Dec. 28, 1998 (JP) ..... 10-373963
Dec. 28, 1998 (JP) ..... 10-373964

(51) Int. Cl.[7] ..... B41J 2/045
(52) U.S. Cl. ..... 347/70
(58) Field of Search ..... 347/70, 68, 54, 347/20, 10, 11, 15, 9, 94, 5

(56) References Cited

U.S. PATENT DOCUMENTS 4,745,138 A * 5/1988 Thanawalla et al. ..... 522/120
5,371,520 A * 12/1994 Kubota ..... 347/11
5,621,443 A * 4/1997 Buschulte et al. ..... 347/73
5,689,291 A * 11/1997 Tence et al. ..... 347/10
5,889,084 A * 3/1999 Roth ..... 523/161
5,980,015 A * 11/1999 Saruta ..... 347/15
6,109,715 A * 8/2000 Masaki ..... 347/11
6,347,854 B1 * 2/2002 Okuda et al. ..... 347/15

* cited by examiner

*Primary Examiner*—Lamson Nguyen
*Assistant Examiner*—K. Feggins
(74) *Attorney, Agent, or Firm*—Parkhurst & Wendel, L.L.P.

(57) ABSTRACT

A recording apparatus has a nozzle (10*a*) containing a viscous substance (11) of a viscosity not lower than 300 cP. A recording electrode (12) is disposed on the nozzle (10*a*) at a position near the forward end of the nozzle (10*a*). A meniscus (13) of the viscous substance (11) is formed on the forward end of the nozzle (10*a*), and then an electric pulse signal corresponding to an image signal is applied to the recording electrode (12) to vibrate the meniscus (13) or to separate a small droplet of the viscous substance (11) from the meniscus (13) and to make the droplet fly. The droplet adheres to a recording medium (15) disposed opposite to the nozzle (10*a*) for recording. The timing of a droplet discharging operation for thus discharging droplets of the viscous substance (11) and the discharge amount of the viscous substance (11) can be controlled through the control of the pulse width or the amplitude of the voltage pulses of the electric pulse signal.

31 Claims, 13 Drawing Sheets

INK JET RECORDING METHOD USING HIGH VISCOUS SUBSTANCE AND APPARATUS FOR CARRYING OUT THE SAME

BACKGROUND OF THE INVENTION

1. Field of the Invention

The present invention relates to a recording method that jets a viscous substance in droplets onto a recording medium according to an electric signal for a recording operation, and an apparatus for carrying out the same.

2. Description of the Related Art

An ink-jet recording system jets ink droplets through minute nozzles directly onto a recording medium, such as a paper sheet to form an image. Ink-jet printers of this ink-jet recording system are used widely as office and domestic printers since they meet the requirements of low cost, high quality, small size and color rendition.

Such printers are classified roughly by system into those of two systems, i.e., printers of a continuous system that jet ink droplets continuously and make only useful ones of the ink droplets reach a recording medium according to an image signal, and printers of a drop-on-demand system that jet only useful ink droplets discontinuously according to an image signal. The latter printers are classified further into those of a piezoelectric system that jet ink droplets by deforming ink passages by the vibration of piezoelectric devices, those of a thermal system that jet ink droplets by pressure produced by bubbles formed in the ink by heat generated by heating elements disposed in ink passages, and those of an electrostatic system that jet ink droplets by electrostatic attraction. The printer of an electrostatic system is being watched with interest recently because of its recording head of simple construction, and its capability of facilitating the fabrication of a multinozzle recording head and of forming gradated images by pulse duration modulation.

A common disadvantage of the ink-jet system is the spread of ink dots printed (recorded) on a recording medium. The ink dots printed on a recording medium dry as the ink penetrates into the recording medium and the volatile constituents of the ink evaporate. Therefore, the ink dots printed on a noncoated paper sheet or a fabric are caused to spread along fibers by capillarity to form a blurred image. Ink dots printed on a film or a metal surface that does not absorb the ink at all take a considerably long time to dry or to be fixed because the ink is unable to penetrate into the film or the metal surface. When recording a full-color image, ink dots are printed before previously printed ink dots dry and hence the boundaries between color regions are blurred.

The foregoing problems can be solved by using a viscous ink having a high viscosity. However, it is usual for the conventional ink-jet printing technique to use inks having a viscosity on the order of several centipoises (cP=0.01 P) because the ink-jet printing technique is able to produce a low force for jetting the ink. The viscosity of the ink which can be used for ink-jet printing is 20 cP at the highest.

A generally known method of solving problems relating to spreading without using viscous inks forms an ink-adsorbing layer on a surface of a recording medium. However, such a recording medium is expensive and the ink-absorbing layer spoils the unique texture of paper sheets and films. Therefore such a recording medium is used only in the field where the cost and the texture of the recording medium are insignificant. Accordingly, it has been believed that most of the conventional image printing methods of printing images on paper sheets and films cannot be replaced with the ink-jet printing method.

A solid ink-jet printing method proposed to overcome the foregoing disadvantages melts an ink which is a solid at an ordinary temperature or reduces the viscosity of such an ink and jets the ink. The ink employed in the solid ink-jet printing method contains a wax as a principal component. The ink is melted by heating the same at about 100° C., the molten ink is supplied to and jetted through a nozzle. An ink dot formed by jetting the molten ink through the nozzle onto a recording medium solidifies rapidly and hence the ink dot does not spread on the recording medium. However, melting the ink takes time and hence a long warm-up time is required. The ink must be heated all the time after warm-up to keep the ink in a molten state. Ink dots printed on a recording medium rise on the recording medium, the rising ink dots invoke a sensation of heavy quality and often form lustrous images, which is a problem concerning design.

Another method to overcome the foregoing disadvantages applies a liquid composition that acts on an ink and exercises an effect of preventing the spread of ink dots to a recording medium prior to the injection of the ink onto the recording medium. Preferably, the liquid composition gelates when the same comes into contact with a color ink to solidify the color ink. This method, however, needs to apply an excessive second liquid to the recording medium to prevent the spread of the ink. Consequently, ink dots rise, the paper sheet becomes wavy and a long drying time is necessary.

The size of ink dots formed on a recording medium by the conventional ink-jet printing technique is several times as large as the diameter of the orifices of nozzles.

The process of formation of ink dots in such a size will be explained with reference to FIG. 24. As shown in FIG. 24, a viscous substance 202 contained in a nozzle 201 is extruded through the orifice of the nozzle 201 by electrostatic attraction or electromechanical force. An extruded portion 203 of the viscous substance 202 lengthens downward in a thread, the thread severs at its upper end, i.e., a portion contiguous with the orifice of the nozzle 201, after lengthening to a certain length, the thread is changed into a spherical droplet 204 by surface tension, and the spherical droplet adheres to a recording medium 205 in a dot. Thus, the size of the dot adhering to the recording medium 205 is five to six times as large as the diameter of the orifice of the nozzle 201. The diameter of the orifice of the nozzle 201 must be reduced to form a smaller dot. Such a nozzle is liable to be clogged with an ink containing large particles, and a portion of the nozzle defining the orifice is abraded by the particles contained in the ink thereby shortening the life of the recording apparatus.

The conventional ink-jet printing technique has difficulty in timing an operation for jetting a viscous substance and controlling the amount of the viscous substance to be jetted. More concretely, the electrostatic system, for instance, jets ink droplets at a predetermined frequency, charges the ink droplets, and make the charged ink droplets fly through a passage between deflecting electrodes to form ink dots. Jetting of the ink is controlled by the on-off control of voltage application across the deflecting electrodes. Therefore, ink droplets which need not form ink dots must be recovered by an ink droplet recovering device, which makes the printing apparatus complicated and large.

SUMMARY OF THE INVENTION

The present invention has been made in view of those problems and it is therefore a first object of the present invention to provide a method and an apparatus capable of jetting a viscous substance having a viscosity of 300 cP or above for patterning (recording), which could not have been achieved by the conventional ink-jet printing technique.

A second object of the present invention is to provide a method and an apparatus capable of forming images on recording mediums including plain paper sheets, films and metal surfaces without permitting spreading and without requiring the formation of a color material recipient layer, such as an ink adsorbing layer or a layer of a liquid composition capable of preventing spreading.

A third object of the present invention is to provide a method and an apparatus capable of suppressing the enlargement of dots formed on a recording medium.

A fourth object of the present invention is to provide a method and an apparatus capable of simply and reliably timing an operation for jetting a viscous substance and controlling the discharge amount of the viscous substance.

According to a first aspect of the present invention, a recording method using a viscous substance comprises the steps of: extruding a drop of the viscous substance from an open forward end of a nozzle filled up with the viscous substance; applying an electric signal corresponding to an image signal to a recording electrode disposed near the open end of the nozzle to vibrate the extruded drop of the viscous substance; and attaching a portion of the extruded drop of the viscous substance to a recording medium disposed opposite to the nozzle by separating the portion of the extruded drop of the viscous substance from the extruded drop of the viscous substance.

Preferably, the recording method according to the first aspect of the present invention further comprises the step of applying a pressure to the viscous substance filling up the nozzle in synchronism with the application of the electric signal to the recording electrode. Preferably, the recording method further comprises the step of heating the extruded drop of the viscous substance extruded from the open forward end of the nozzle. Preferably, the recording method further comprises the step of curing the viscous substance adhering to the recording medium with ultraviolet rays.

Preferably, the electric signal used in the step of applying the electric signal is a voltage pulse signal having a plurality of voltage pulses. Preferably, the timing of an operation for discharging droplets of the viscous substance is controlled by controlling the pulse width of the voltage pulses of the voltage pulse signal. Preferably, the discharge amount of the viscous substance is controlled by controlling the amplitude of the voltage pulses of the voltage pulse signal.

According to a second aspect of the present invention, a recording apparatus using a viscous substance comprises: a nozzle filled up with the viscous substance; a recording electrode disposed near an open forward end of the nozzle; and an electric signal applying unit for applying an electric signal corresponding to an image signal to the recording electrode to vibrate a drop of the viscous substance extruded from the open forward end of the nozzle.

It is preferable, in the recording apparatus according to the second aspect of the present invention, that the electric signal is a voltage pulse signal having a plurality of voltage pulses and the timing of an operation for discharging the viscous substance is controlled by controlling the pulse width of the voltage pulses of the voltage pulse signal. Preferably, the electric signal is a voltage pulse signal having a plurality of voltage pulses, and the electric signal applying unit controls the discharge amount of the viscous substance by controlling the amplitude of the voltage pulse signal.

As apparent from the foregoing description, according to the present invention, a pattern of a viscous substance having a viscosity of 300 cP or above can be recorded, which could not have been achieved by the conventional ink-jet printing technique.

According to the present invention, sharp and unblurred images can be formed on recording mediums including plain paper sheets, fabrics, films and metal surfaces because the viscous substance is used as an ink.

According to the present invention, the tip of a drop of the viscous substance extruded from the open forward end of the nozzle and having the shape of a circular cone is brought into contact with a recording medium and hence a small dot of the viscous substance can be formed on the recording medium.

According to the present invention, the timing of the operation for discharging the viscous substance and the discharge amount of the viscous substance can simply and accurately be controlled simply by varying the pulse width, the waveform or the amplitude of the voltage pulses of the voltage pulse signal and, therefore, a pattern of the viscous substance can very easily be formed.

The present invention can be applied not only to processes for forming images but also to processes for forming irregularities, such as a process for forming ribs for a plasma display and a process for forming the gap medium of a liquid crystal display. The present invention is particularly effectively applicable to the formation of the gap medium of a liquid crystal display.

In the liquid crystal display, minute glass beads are dispersed in a space between a pair of glass substrates to secure a gap for a liquid crystal. Those glass beads are impediments to displaying images by the liquid crystal. An improvement forms projections of a photoresist selectively in a non-displaying region (shaded region) of a color filter by a resist pattern forming process, which makes processes complicated and reduces the yield of the processes. The present invention forms projections selectively by small droplets directly on the color filter, which simplifies the manufacturing process and the gap medium can be formed at a small material loss.

DESCRIPTION OF THE PREFERRED EMBODIMENTS

Preferred embodiments of the present invention will be described hereinafter with reference to the accompanying drawings.

First Embodiment

A recording apparatus in a first embodiment according to the present invention will be described with reference to FIGS. 1 to 5.

Figure 1:
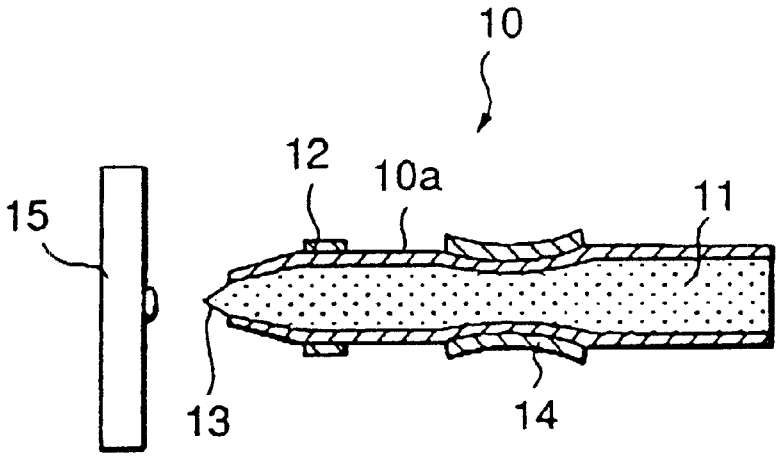
FIG. 1 is a sectional view of a nozzle structure employed in a first embodiment according to the present invention.
Figure 2:
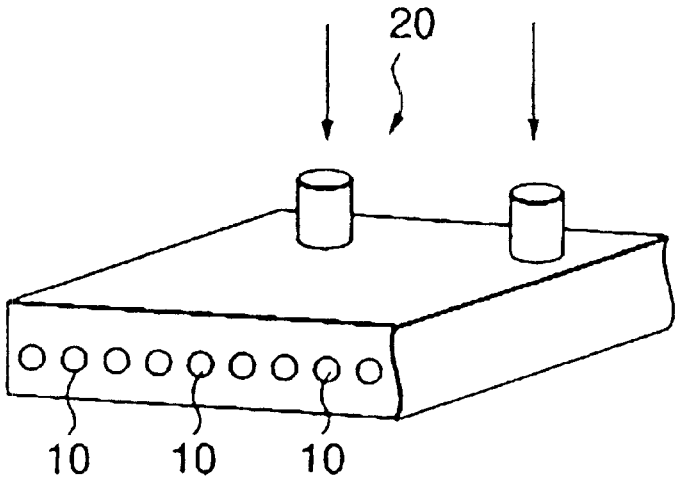
FIG. 2 is a schematic perspective view of a recording head provided with a plurality of nozzle structures each corresponding to that shown in FIG. 1.

FIG. 1 is a sectional view of a nozzle structure employed in a recording apparatus in a first embodiment according to the present invention using a viscous substance, and FIG. 2 is a schematic perspective view of a recording head provided with a plurality of nozzle structures each corresponding to that shown in FIG. 1.

Referring to FIG. 1, a nozzle structure 10 has a nozzle 10*a* filled up with a viscous substance 11. A recording electrode 12 is disposed near the forward end of the nozzle 10*a*. The viscous substance 11 filled in the nozzle 10*a* is pressurized by a pressure device (first pressure device), not shown. An appropriate voltage pulse signal (electric signal) is applied to the recording electrode 12 to print the viscous substance 11 filled in the nozzle 10*a*.

The nozzle 10*a* is made of an insulating material or a metal in a shape substantially resembling a rectangular parallelepiped or a cylinder. The rear end of the nozzle 10*a* is connected to an ink chamber, not shown, for storing the viscous substance 11 for replenishing the nozzle 10*a*. The pressure device, not shown, forces the viscous substance 11 into the nozzle 10*a*. An appropriate pressure is applied continuously or intermittently to the viscous substance 11 so that a meniscus 13 formed in a forward end portion of a bar of the viscous substance 11 in a fixed shape. When further stable recording is desired, a piezoelectric device 14 as a pressure device (second pressure device) is provided on the nozzle 10*a* as shown in FIG. 1 to apply pressure to the viscous substance 11 in synchronism with the application of a voltage to the recording electrode 12. Preferably, the pressure device capable of applying pressure to the viscous substance 11 in synchronism with voltage application is a piezoelectric transducer.

An orifice of 200 $\mu$m or below in diameter is formed at the forward end of the nozzle 10*a*. The semispherical or conical meniscus 13 is formed so as to project forward from the orifice It is preferable that a forward end portion of the nozzle 10*a* is formed of a material having high surface free energy, such as Teflon, in order that the viscous substance 11 may not spread over the outer surface of the front end portion of the nozzle 10*a* and the outer surface of the front end portion of the nozzle 10*a* may not be wetted by the viscous substance 11. If the viscous substance 11 wets the outer surface of the forward end portion of the nozzle 10*a*, the shape of the meniscus 13 becomes unstable, and the viscous substance 11 remains on the outer surface of the front end portion of the nozzle 10*a* when a power supply for applying a voltage to the recording electrode 12 is disconnected from the recording electrode 12. The residual viscous substance 11 contaminates the nozzle 10*a* and affects adversely to the next recording operation.

When the nozzle 10*a* is formed of an insulating material, the recording electrode 12 is disposed near the forward end of the nozzle 10*a*. The recording electrode 12 may be disposed on either the inner surface or the outer surface of the nozzle 10*a*. Preferably, the recording electrode 12 is placed on the outer surface of the nozzle 10*a* to avoid being corroded by the viscous substance 11. There is no particular restriction on the distance from the forward end of the nozzle 10*a* and the recording electrode 12, from which it is known that the recording principle of the present invention is entirely different from that of the conventional electrostatic ink-jet printing system. The inventors of the present invention changed gradually the distance between the forward end of the nozzle 10*a* and the recording electrode 12 and found that the recording operation using the viscous substance 11 is possible when the distance was as great as 10 cm or above. Such great freedom in determining the position of the recording electrode 12 is a significant advantage in designing a nozzle and hence a multinozzle head.

The corrosive action on the recording electrode 12 and the clogging action of some type of the viscous substance 11 are negligible. When such a viscous substance 11 is used, the nozzle 10*a* may be formed of a metal, the recording electrode 12 may be omitted and a voltage signal may directly be applied to the nozzle 10*a*.

The application of the voltage to the recording electrode 12 causes either of the following changes in the meniscus 13 formed at the forward end of the nozzle 11*a*.

(1) The meniscus 13 vibrates so as to extend toward a recording medium 15 and contract away from the recording medium 15 (extension and contraction), and forms a dot on the recording medium 15 when the same extends.

(2) A tip portion of the meniscus 13 breaks off the meniscus 13, flies toward the recording medium 15 and falls on the recording medium 15 to form a dot.

The occurrence of either of those changes is greatly dependent not only on the type of the viscous substance 11 but also on the mode of voltage application and the material forming the nozzle 10*a*. Although a sharp dot can be formed by either of those changes, the principle of the changes has not yet been elucidated.

The distance between the nozzle 10*a* and the recording medium 15 is in the range of 0.1 to 10 mm, preferably, in the range of 0.1 to 3 mm. A stable meniscus 13 cannot be formed and dots link up or are omitted owing to small irregularities in the recording medium 15 when the distance is shorter than 0.1 mm. Dots spread undesirably and sharp images cannot be formed when the distance is greater than 10 mm.

A pattern of the viscous substance 11 having a viscosity of 300 cP or above can be formed on the recording medium 15 in a noncontact mode by this embodiment. There is not any particular morphological restriction on the viscous substance 11 employed in this embodiment, provided that the viscous substance 11 is fluidic; that is, the viscous substance 11 may be a liquid, a colloid, a paste or the like.

Possible materials to be used as the viscous substance 11 in this embodiments are (1) resins, such as UV curable resins, epoxy resins and acrylic resins, and solutions of those resins, (2) solid materials that liquefy upon heating, such as paraffin waxes and carnauba wax, (3) high-concentration suspensions of organic pigments, such as copper phthalocyanine, or inorganic pigments, such as titanium oxide, (4) polyhydric alcohols, such as glycerol, (5) adhesives, such as UV curable adhesives hot-melt adhesives, pressure-sensitive adhesives, one-component epoxy adhesives, two-component epoxy adhesives, rubber adhesives, cyanoacrylate adhesives and anaerobic adhesives, (6) materials used for fabricating semiconductor devices, such as conductive paste, solder pastes and resists, (7) lubricants, such as silicone oil, industrial oils, engine oils and greases, (8) foodstuffs, such as source and ketchup, and (9) coloring materials, such as enamel, lacquer, paints, printing inks, condensed liquid toners, writing inks, water paints and oil paints.

Preferable viscous substances 11 to be used by this embodiment are thixotropic substances. Thixotropy is a property of certain gels that reduces its viscosity temporarily when subjected to vibratory forces, particularly, shearing forces, and then restores its original high viscosity when left standing. Some colloidal systems, particularly, suspensions, and some polymer solutions have thixotropy. It is known that the variation of viscosity of a system by thixotropy is caused by the breakage of continuous structures formed in the system by attraction between dispersed particles by shearing, and the restoration of the continuous structures when the system is left standing.

When the viscous substance 11 used in this embodiment is a thixotropic substance, a viscosity slope is formed in the viscous substance 11 contained in the nozzle 10*a* by application of a shearing force to the viscous substance 11, and the viscosity slope affect advantageously to recording. A shearing force generated by vibrations or breaking actions generated by the voltage signal is applied to a tip portion of the meniscus 13 and the viscosity of the tip portion of the meniscus 13 decreases and hence the tip portion of the meniscus 13 can be transferred to the recording medium by smaller energy. On the other hand, any high shearing force is not applied to portions of the viscous substance 11 other than the tip portion of the meniscus 13 and hence those portions have a sufficiently high viscosity. Therefore, those portions of the viscous substance 11 are difficult to be transferred to the recording medium 15. The meniscus 13 is able to maintain a stable shape by the agency of gravity and the viscous substance 11 is able to drip scarcely while the recording apparatus is not in operation. These characteristics enables the nozzle of an inside diameter equal to that of the nozzle of the conventional recording apparatus to form smaller dots and improves the safety of a continuous recording operation.

Preferably thixotropy meets a condition expressed by:

$$\eta_1 \geqq 300 \text{ cP; and}$$

$$\eta_1 \geqq \eta_2,$$

where $\eta_1$ is the apparent viscosity at a shear rate of 0.1 (l/s) and $\eta_2$ is the apparent viscosity at a shear rate of 100 (l/s).

When the viscous substance 11 is not a thixotropic substance, the viscous substance 11 can be made thixotropic and the recording ability can be improved by adding a thixotropic agent to the viscous substance 11. The thixotropic agent is a material capable of forming some structure in a system to provide the system with thixotropy or to increase the viscosity of the system when a small amount of the same is added to the system. Concrete examples of thixotropic agents are ultrafine silica powder, clay minerals, such as montmorillonite, kaolinite and derivatives of montmorillonite and kaolinite, polyamide wax, hydrogenated castor oil, polyethylene oxide and surface-active agents.

Dots of some viscous substance 11 do not separate from each other, form threads and are linked in a line. When such a viscous substance is used, it is preferable to heat the meniscus 13. The heating of the meniscus 13 improves the recording characteristic. It is inferred that the heating of the meniscus 13 reduces the viscosity and affects the electric conductivity and the surface tension, and the combined effect of those effects improves the recording characteristic. Actions of heating is complex and difficult to infer. It is known that there are optimum temperature ranges respectively for different viscous substances.

The meniscus 13 may be heated by a heater combined with the nozzle 10*a*. However, such a heater, in most case, is not suitable for heating the meniscus 13. It is preferable to heat the meniscus 13 with hot air or infrared rays emitted by an infrared lamp.

Figure 3:
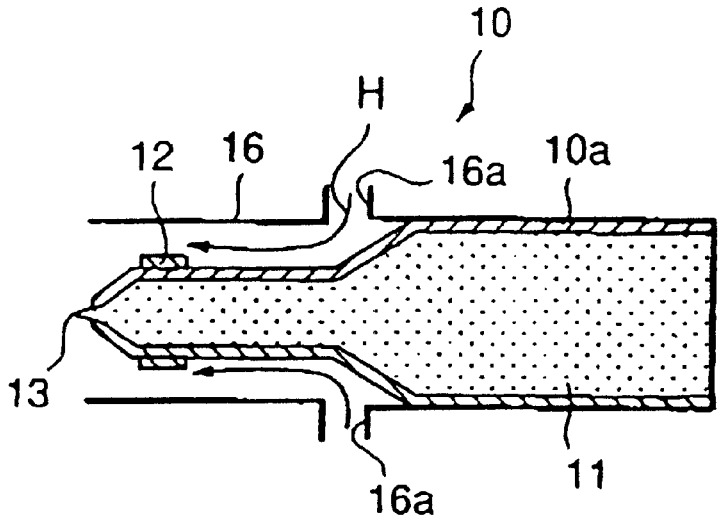
FIG. 3 is a sectional view of a nozzle structure in a modification of the nozzle structure shown in FIG. 1.

FIG. 3 shows a nozzle structure 10 in which hot air is used for heating. When hot air is used for heating, hot air flowing in some direction affects adversely to the safety of recording. Therefore, it is preferable to surround a nozzle 10*a* by a cover 16 having the shape resembling a cylinder or a rectangular parallelepiped, having an open forward end and provided with an air inlet 16*a*, and to blow hot air H through the air inlet 16*a* into the cover 16 so that hot air H flows from the rear side of the nozzle 10*a* toward the recording medium 15.

Figure 4:
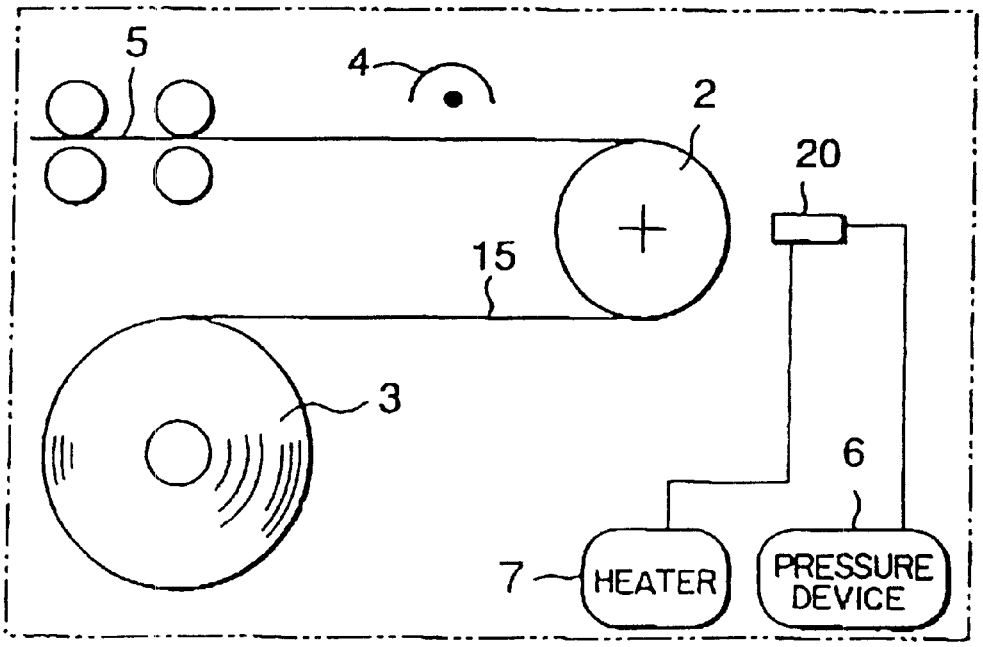
FIG. 4 is a schematic view of a recording apparatus in the first embodiment using a viscous substance.

FIG. 4 shows the recording apparatus in the first embodiment using the viscous substance.

In this recording apparatus, a recording medium 15 in the form of a film is supplied from a roll 3. There is not any particular restrictions on the material and shape of the recording medium 15.

A power supply and a pulse generator (pulse applying unit), not shown, are connected to a recording electrode included in a recording head 20 to apply a voltage signal corresponding to a pattern (image signal) to the recording electrode. A heater (heating device) 7 is capable of supplying hot air of a fixed temperature in the range of a room temperature to 100° C. and of regulating the flow of the hot air. A pressure device (first pressure device) 6 is connected to a rear part of the recording head 20 to maintain the meniscus 13 in a fixed shape by applying pressure to the viscous substance 11. When a plurality of types of viscous substances 11 are used for recording, a plurality of recording heads 20 similar to the foregoing recording head 20 are used.

The recording medium 15 is wound around a grounded metal drum 2. Dots of the viscous substance are formed on the recording medium 15 on the metal drum 2, and the same are dried and fixed. When the recording medium 15 has a highly smooth or slick surface, the surface of the metal drum 2 is roughened to prevent the recording medium 15 from slipping relative to the metal drum 2 so that the recording medium 15 can stably be fed.

The dots of the viscous substance are dried by evaporating the solvent of the viscous substance or by irradiation with UV rays (ultraviolet ray) or an EB (electron beam). This embodiment uses a UV curable substance as the viscous substance 11 and hence a UV radiating device 4 is employed in a drying process. After the dots have been dried, the recording medium 15 is cut in a desired size with a cutter 5 to complete a series of processes.

In this embodiment, the nozzle 10*a* and the recording medium 15 move relative to each other. At least either the nozzle 10*a* or the recording medium 15 may be moved. For example, the recording head 20 provided with the nozzle may be kept stationary, and the recording medium 15 may be moved by the metal drum 2 for recording, as shown in FIG. 4.

Both the nozzle 10*a* and the recording medium 15 way simultaneously be moved for recording. High-speed recording can be achieved by moving the nozzle 10*a* and the-recording medium 15 in opposite directions, respectively.

It is possible to form dots of the viscous substance at the same position by keeping both the nozzle 10*a* and the recording medium 15 stationary and making small droplets of the viscous substance 11 fly successively. Thus, dots having a high aspect ratios and a higher gradation can be formed.

The aspect ratio of a dot is the ratio of the thickness of the dot (mean thickness of dots) to the diameter of the dot.

(Aspect ratio)=(Thickness of dot)/(Diameter of dot)

A dot structure (recording medium) formed by this embodiment has dots having diameters in the range of 1 to 300 $\mu$m and dot aspect ratios in the range of 0.33 to 20. The dot structure having such dots of diameters and dot aspect ratios in the foregoing ranges presents a characteristic image having high sharpness, high fidelity, high density, high stereoscopic effect and high reality. For example, high-fidelity images can be formed by an offset printing process. However, an offset printing process is incapable of printing dots of aspect ratios not smaller than 0.1 and of high-density recording. An electrophotographic image forming process is incapable of forming dots of aspect ratios not smaller than 0.2.

A screen printing process is capable of forming dots having diameters of about 10 $\mu$m and relatively large aspect ratios. Basically, it is difficult to achieve accurate printing by a screen printing process because the printing plate is deformed during printing and the quality of the printing screen changes with time. This embodiment is able to form dots stably because the nozzle is not deformed and the quality of the nozzle does not change with time.

EXAMPLE 1

Examples of the first embodiments will be described hereinafter.

Test recording operation was performed by using the recording apparatus shown in FIG. 4 and a viscous substance. The recording head 20 was provided with a nozzle structure 10 similar to that shown in FIG. 3.

Figure 5:
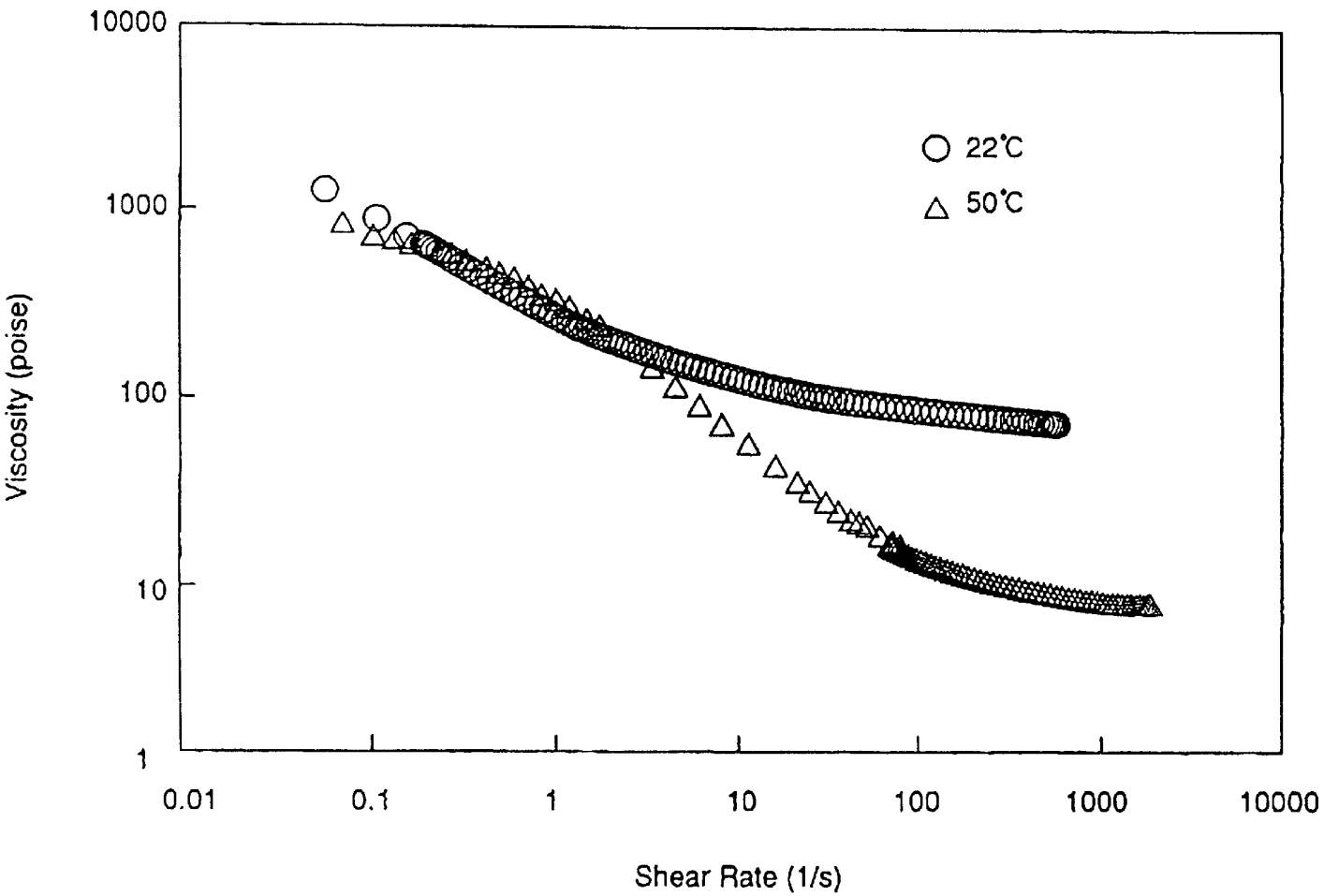
FIG. 5 is a graph showing the Theological characteristics of a UV curable ink for silk screen printing at a room temperature (22° C.) and 50° C.

A UV curable ink for screen printing was used as the viscous substance 11. FIG. 5 shows the Theological properties of the ink at a room temperature (22° C.) and 50° C., in which shear rate (l/s) is measured on the horizontal axis, and viscosity ($P=10^{-1}$ Pa·s) is measured on the vertical axis.

Table 1 shows the apparent viscosity $\eta_1$ at a shear rate of 0.1 (l/s) and the apparent viscosity $\eta_2$ at a shear rate of 100 (l/s).

This ink has a satisfactory thixotropy. It is known from Table 1 that the apparent viscosity at a higher temperature decreases greatly when the ink is heated to enhance the thixotropy of the ink.

TABLE 1

| Temperature (° C.) | $\eta_1$ (cP) | $\eta_2$ (cP) |
|---|---|---|
| 22 | 89,000 | 7,900 |
| 50 | 70,800 | 1,300 |

Dots of the viscous substance 11 were formed by using the following conditions.

Nozzle

Material: Polypropylene

Diameter of orifice (Tip portion): 260 $\mu$m

Thickness of wall: 125 $\mu$m

Position of recording electrode: 3000 $\mu$m from the tip

Recording medium: Polycarbonate film

Recording medium moving speed: 8 m/min

Frequency of voltage signal: 1000 Hz

Voltage: 4 kV

Nozzle heater temperature: 50° C.

Extrusion pressure from the rear of the nozzle: 0.3 bar

Nozzle-recording medium distance: 4 mm

Drying unit: UV lamp

The vibration of the meniscus 13 formed at the forward end of the nozzle 10*a* and the successive formation of dots on the recording medium 15 when the voltage signal is applied to the recording electrode 12 was recognized from pictures taken by a high-speed video camera. It was found from the observation of a recorded image with a microscope that 30 $\mu$m diameter dots were arranged at equal intervals without omitting any dots. Although the recording medium 15 was a film, sharp dots were formed and there was no spreading and running of the viscous substance 11 forming the dots. The aspect ratio of the dots was as high as 2.0 and sharp dots were formed.

Second Embodiment

A recording apparatus in a second embodiment according to the present invention will be described with reference to FIGS. 6 to 23.

Figure 6:
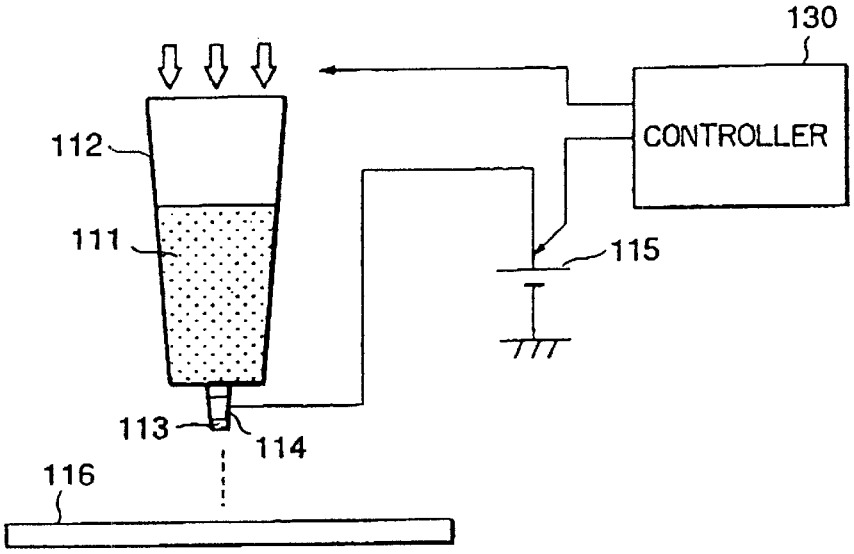
FIG. 6 is a schematic view of a recording apparatus in a second embodiment according to the present invention using a viscous substance.

FIG. 6 is a schematic view of the recording apparatus in the second embodiment using a viscous substance.

Referring to FIG. 6, a syringe 112 contains a highly viscous ink (a viscous substance) 111 containing particles of a fluorescent material or the like dispersed therein. The syringe 112 is provided in its lower end portion with a nozzle 113 of Teflon or polypropylene. The nozzle 113 has an orifice (opening) at its forward end. The diameter of the orifice is determined selectively according to necessary conditions including the viscosity and the discharge rate of the viscous substance 111 and the size of the particles contained in the viscous substance 111. A recording electrode 114 is mounted on the nozzle 113. A power supply 115 controlled by a controller 130 applies a voltage pulse signal of a voltage in the range of 1 to 10 kV to the recording electrode 114. The nozzle 113 is formed of an insulating material. Voltage pulses are applied to the recording electrode 114 mounted on the nozzle 113. The recording electrode 114 need not necessarily be disposed on the nozzle 113 and may be disposed at any suitable place, provided that the place is on a level lower than the surface of the ink contained in the syringe 112. The nozzle 113 need not necessarily be formed of an insulating material and may be formed of a metal. If the nozzle 113 is formed of a metal, the recording electrode 114 may be omitted and the nozzle 113 may be used also as a recording electrode. The orifice need not necessarily be formed at the forward end of the nozzle 113. One or a plurality of orifices may be formed on the bottom wall of the syringe 112 or an ink container containing the ink. When necessary, a predetermined pressure is applied to the viscous substance 111 by a pressure device (first pressure device), not shown, controlled and driven by a controller 130. If the property of the viscous substance 111 requires, the viscous substance 111 may be heated at a temperature in the range of 50 to 150° C. by a heating device, not shown. The recording medium 116 need not necessarily serve as a counter electrode; the recording medium 116 may be a paper sheet, a film, a glass plate or the like. The recording medium 116 need not necessarily be flat; the recording medium 116 may be curved or may have irregularities. Preferably, the distance between the orifice of the nozzle 113 and the recording medium 116 is in the range of about 0.1 to about 10 mm.

Figure 7:
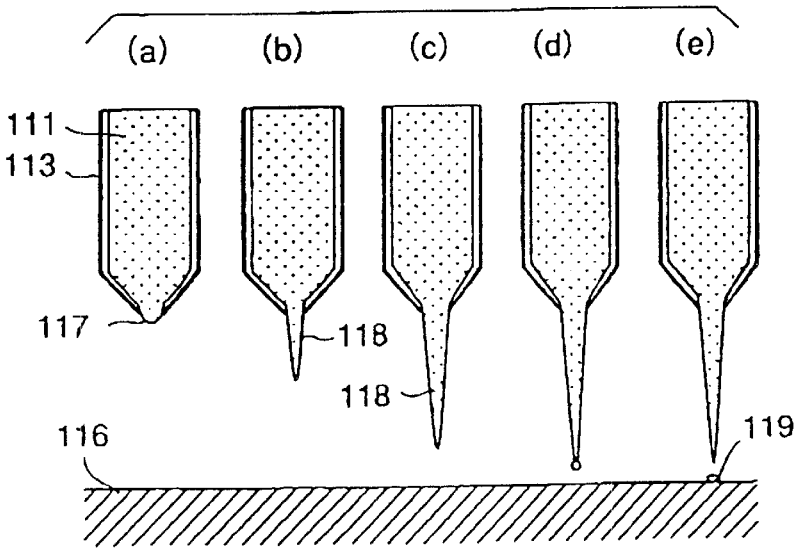
FIG. 7 is a view of assistance in explaining a mode of discharging the viscous substance by the recording apparatus shown in FIG. 6.

A viscous substance discharging method to be carried out by the recording apparatus shown in FIG. 6 will be described with reference to FIGS. 7, 8A, 8B, 8C, 9A and 9B. FIG. 7 is a view of assistance in explaining a mode of discharging the viscous substance, FIGS. 8A, 8B and 8C are diagrammatic views of voltage pulse signals to be applied to the recording electrode, and FIGS. 9A and 9B are views of assistance in explaining a meniscus formed near the orifice of the nozzle.

Referring to FIG. 6, the viscous substance 111 filled in the syringe 112 extrudes itself gradually by gravity through the nozzle 113 and forms a meniscus 117 as shown in FIG. 7(*a*). Some diameter of the orifice and the properties of some viscous substance 111 require a long time for forming the meniscus 117 by gravity or make the formation of the meniscus 117 impossible. In such a case, a pressure is applied to the viscous substance 111 by the pressure device to form the meniscus 117 forcibly. When necessary, the viscous substance 111 is heated to promote the formation of the meniscus 117. When a voltage pulse signal as shown in FIG. 8A, 8B or 8C is applied to the recording electrode 114 after the meniscus 117 has been formed, the meniscus 117 lengthens in the shape of an elongate cone 118 as shown in FIGS. 7(*b*) and 7(*c*), and a tip portion of the elongate cone 118 breaks off (FIG. 7(*d*)) to form a dot 119 on a recording medium 116 as shown in FIG. 7(*e*).

Figure 8A:
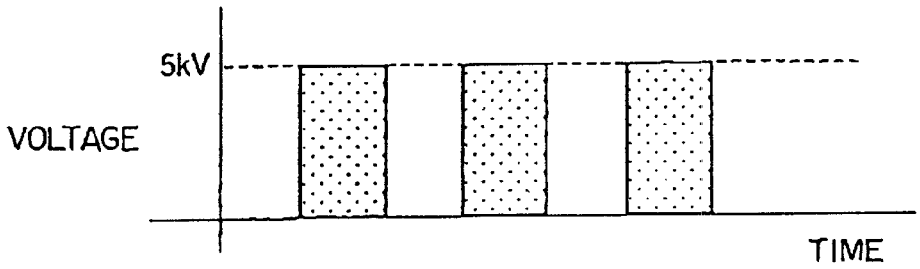
FIGS. 8A, 8B and 8C are diagrammatic views of assistance in explaining voltage pulse signals to be applied to a recording electrode included in the recording apparatus shown in FIG. 6.
Figure 8B:
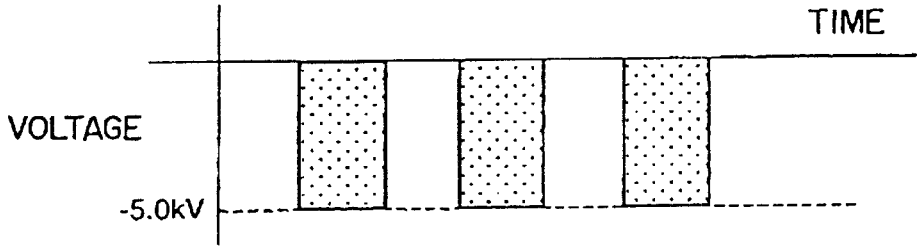
Figure 8C:
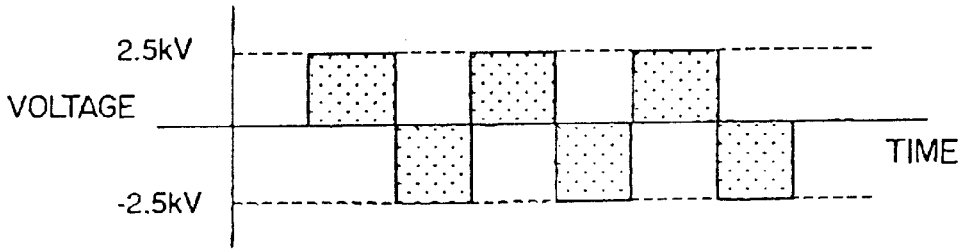
Figure 9A:
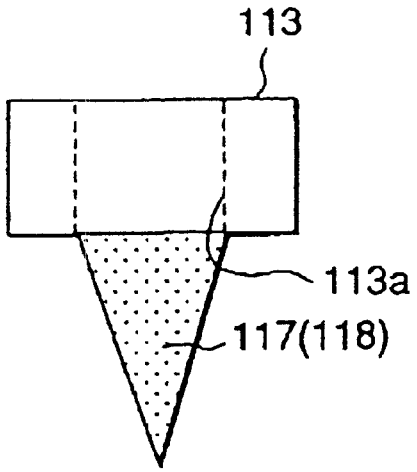
FIG. 9 is a view of assistance in explaining a meniscus formed near an open end of a nozzle.
Figure 9B:
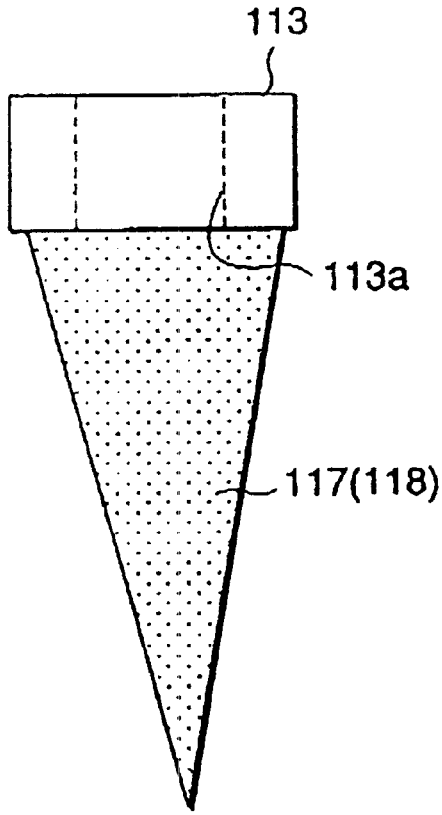

One of voltage pulse signals shown in FIGS. 8A, 8B and 8C may be applied to the recording electrode 114 to discharge the viscous substance 111. The voltage pulse signal shown in FIG. 8A has a frequency in the range of 10 Hz to 100 kHz and rectangular voltage pulses of 0 V–(5 kV). The voltage pulse signal shown in FIG. 8B has rectangular voltage pulses of 0 V–(−5 kV). The voltage pulse signal shown in FIG. 8C has alternate rectangular voltage pulses of 0 V–(2.5 kV) and those of 0 V–(2.5 kV). The offset voltage of the voltage pulse signal need not necessarily be 0 kV and may be of any value, provided that the voltage pulses have an amplitude not smaller than a predetermined amplitude.

The shape of the elongate and conical meniscus 117 (118) is dependent on the amplitude of the voltage pulse signal, the Theological characteristic of the viscous substance 111 and so on. For example, the meniscus 117 tapers off sharply away from the orifice 113*a* of the nozzle 113 as shown in FIG. 9A when the voltage pulse signal has a great amplitude, and the meniscus 117 tapers off gradually away from the orifice 113*a* of the nozzle 113 as shown in FIG. 9B when the voltage pulse signal has small amplitude. Supposing that the recording apparatus using the viscous substance is provided with a slender nozzle as shown in FIG. 6, the diameter of a portion of the meniscus 117 corresponding to the orifice of the nozzle 113 is equal to the inside diameter of the nozzle 113, i.e., the diameter of the orifice (FIG. 9A) when the voltage pulse signal has a great amplitude, and the same is substantially equal to the outside diameter of the nozzle 113 (FIG. 9B) when the voltage pulse signal has a small amplitude. Therefore, the meniscus 117 converges in a point at a position apart from the recording medium 116 if the amplitude of the voltage pulse signal is excessively great. If the recording medium 116 is flat, the viscous substance 111 adheres to the recording medium 116 in a certain range around the center of the meniscus 117 because lines of electric force diverge from the nozzle 113 toward the recording medium. The intensity of such a tendency increases with the increase of the distance between the tip of the meniscus 117 and the recording medium 116 and the viscous substance 111 adheres to the recording medium 116 in a wide range. Therefore, when forming minute dots of the viscous substance 111 on the recording medium 116 or when forming a thin line of the viscous substance 111 on the recording medium 116 by moving the orifice 113*a* of the nozzle 113 and the recording medium 116 relative to each other, the distance between the tip of the meniscus 117 and the recording medium 116 can be reduced by using a voltage pulse signal having a small amplitude or by reducing the distance between the orifice 113*a* of the nozzle 113 and the recording medium 116. If the meniscus 117 comes into contact with the recording medium 116 before the meniscus 117 tapers off completely to a point, the viscous substance 111 sticks to the recording medium 116. Therefore, dots or a line of the viscous substance 111 can be formed on the recording medium 116 by varying the amplitude of the voltage pulse signal to control the diameter of the dots or the width of the line. The diameter of the dots or the width of the line thus formed is not greater than half the diameter of the orifice of the nozzle 113.

Preferably, the viscous substance 111 employed in this embodiment has a viscosity in the range of 1,000 to 1,000,000 cP in view of maintaining the viscous substance 111 in a shape and filling the viscous substance 111 in the nozzle 113. Preferably, the viscous substance 111 contains particles of particle sizes not greater than 1/10 of the diameter of the orifice of the nozzle 113. Particularly, it is preferable that the mean particle size of the particles is in the range of 1 to 10 μm.

Possible materials to be used as the viscous substance 111 in this embodiment are, for example, instantaneous adhesives, paints, inks, high-viscosity one-component epoxy adhesives, two-component RTV rubber, silver pastes, solder pastes, industrial greases and fluorescent materials. Resins containing glass beads also are possible materials. Such resins can be used for forming a spacer to be formed between the two glass substrates of a liquid crystal display.

Concrete examples of the second embodiment will be described hereinafter.

EXAMPLE 2

Figure 10:
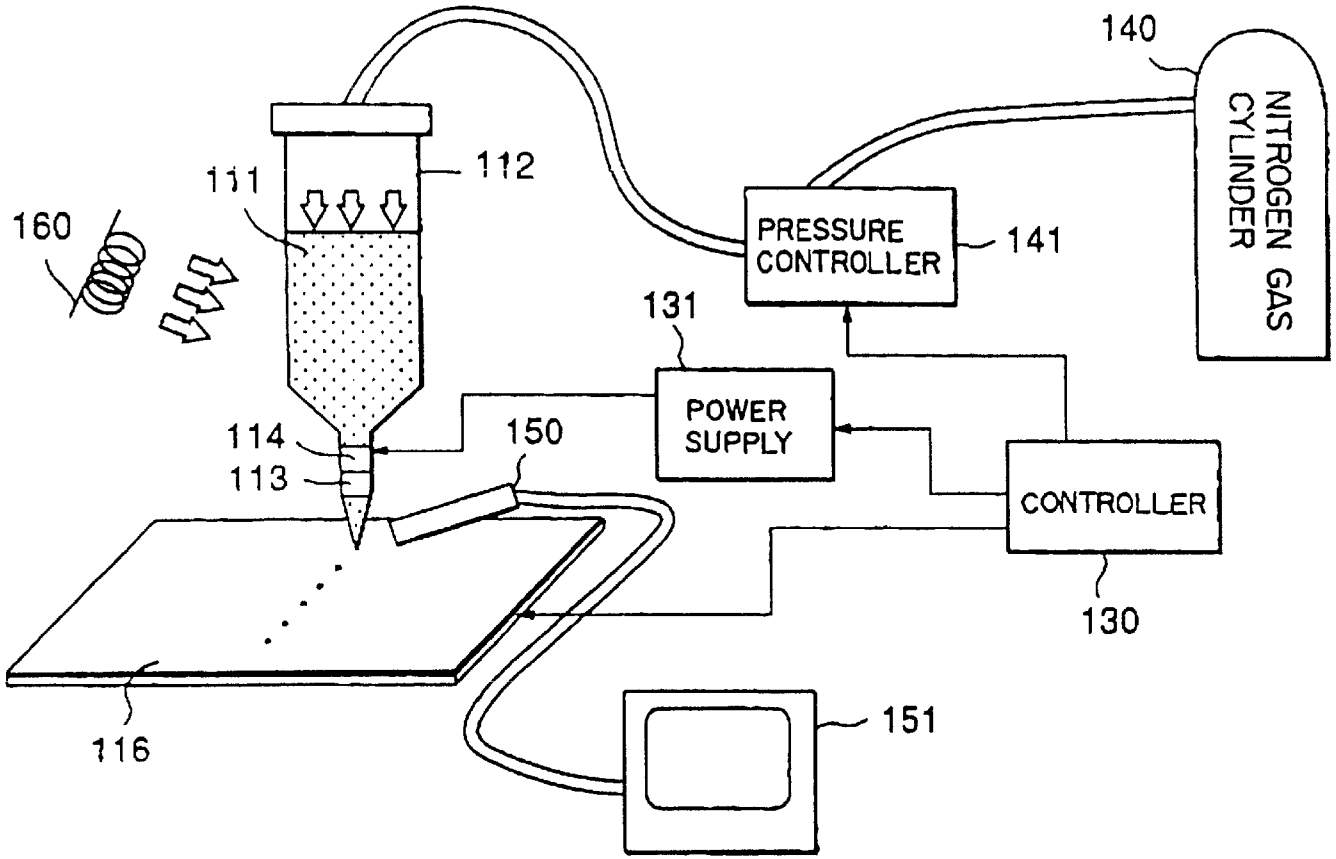
FIG. 10 is a block diagram of an example of the recording apparatus in the second embodiment using the viscous substance.

FIG. 10 shows a recording apparatus using a viscous substance in Example 2 of the recording apparatus using a viscous substance in the second embodiment.

Test recording operations were performed by using the recording apparatus shown in FIG. 10. The following fluorescent paste was used as the viscous substance.

Fluorescent paste

Fluorescent material: P1-GlS (Red KX-504A, Blue KX-501A)(available from Kasei Oputonikusu), 65% by weight Acrylic resin: MP-4009 (available from Souken Xagaku), 100% by weight Solvent: Butylcarbitol acetate:Butylcarbitol=1:1, 25% by weight The fluorescent paste was prepared by mixing and kneading those materials and processing the mixture of those materials with three rollers.

The viscosity of the fluorescent paste was 70,000 cP.

Referring to FIG. 10, a syringe 112 is provided in its lower part with a nozzle 113 of about 270 $\mu$m in inside diameter made of Teflon. The nozzle 113 is electrically nonconducting. An electrode 114 is put on the nozzle 113 at a position near the orifice. A high voltage is applied to the electrode 114. A recording medium 116 is supported on an XY stage, not sown, capable of moving in horizontal directions. The position of the recording medium 116 relative to the nozzle 113 of the syringe 112 with respect to horizontal directions can optionally be changed. Pressure in the syringe 112 can optionally be adjusted by using a nitrogen gas cylinder 140 and a controller 141. When necessary, the respective temperatures of the syringe 112 and the viscous substance 111 contained in the syringe 112 are controlled by using a heating unit 160. The operations of those components are controlled by a controller 130. The controller 130 controls a power supply 131, a pressure controller 141 and the XY stage, not shown, to regulate the pressure in the syringe 112, the amplitude and timing of a voltage pulse signal, discharging position and the discharge amount of the viscous substance so that the viscous substance 111 contained in the syringe 112 is discharged onto the recording medium 116 in a pattern. The mode of discharge of the viscous substance 111 was photographed by a CCD camera 150 for observation.

The viscous substance 111 was discharged by using the following conditions.

Nozzle

Material: Teflon

Inside diameter of nozzle (Diameter of orifice): 270 $\mu$m

Substrate (Recording medium): Glass

Nozzle-substrate distance: 0.75 mm

Pressure: 3 atm

Temperature: Room temperature (25° C.)

Voltage applied (Frequency): 2 to 15 kV

Offset: −2.5 to 2.5 kV (Amplitude: 5 kV)

Frequency: 10 Hz to 1 kHz

Waveform: Rectangular pulses

Figure 11:
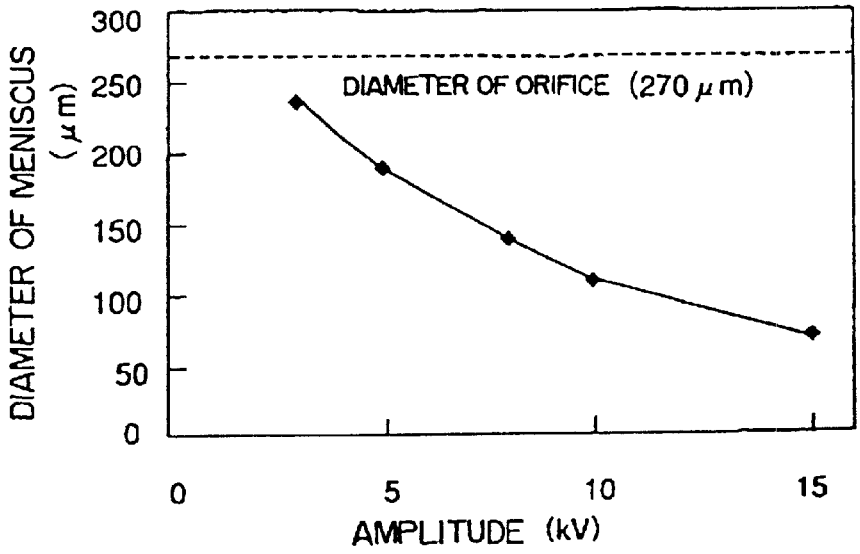
FIG. 11 is a graph showing the relation between the amplitude of the voltage pulse signal applied to a recording electrode included in the example shown in FIG. 10 and the diameter of a meniscus formed in a nozzle.

The amplitude of the voltage pulse signal was varied in the range of 2 to 15 kV (offset: 0 V, frequency: 1 kHz). A meniscus of the viscous substance 111 was photographed by the CCD camera 150 to observe the shape of the meniscus. The meniscus lengthened in a conical shape and the viscous substance 111 was discharged when the amplitude was 3 kV or above. It was found through the measurement of the diameter of a portion of the neniscus in a plane at 0.25 mm from the orifice of the nozzle 113 that the greater was the amplitude of the voltage pulse signal, the smaller was the diameter of the meniscus represented by the diameter of a portion of the conical meniscus at a distance equal to ⅓ of the length of the conical meniscus as shown in FIG. 11 when the amplitude was 10 kV or above.

The amplitude and the frequency of the voltage pulse signal were fixed at 5 kV and 1 kHz, respectively, the offset voltage was varied in the range of −2.5 to 2.5 kV, and the meniscus was photographed by the CCD camera 150 to observe the shape of the meniscus. The shape of the meniscus and the viscous substance discharging mode were the same as those in a state where the offset voltage was 0 V.

Figure 12A:
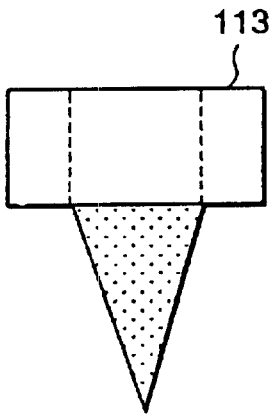
FIGS. 12A and 12B are views of assistance in explaining a meniscus formed in the example shown in FIG. 10.
Figure 12B:
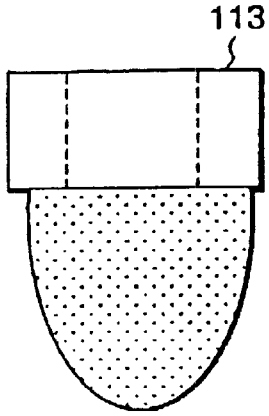

The amplitude and the offset voltage of the voltage pulse signal were fixed at 5 kV and 0 V, respectively, the frequency of the voltage pulse signal was varied in the range of 10 Hz to 1 kHz, and the shape of the meniscus and the viscous substance discharging mode were observed. The meniscus lengthened rapidly as shown in FIG. 12A upon the application of the voltage pulse signal to the electrode and the viscous substance 111 was discharged when the frequency was 1 kHz. The response of the meniscus to voltage pulse application lowered with the decrease of the frequency. The meniscus assumed a swollen shape as shown in FIG. 12B and the discharge of the viscous substance was unstable when the frequency was low.

Figure 13:
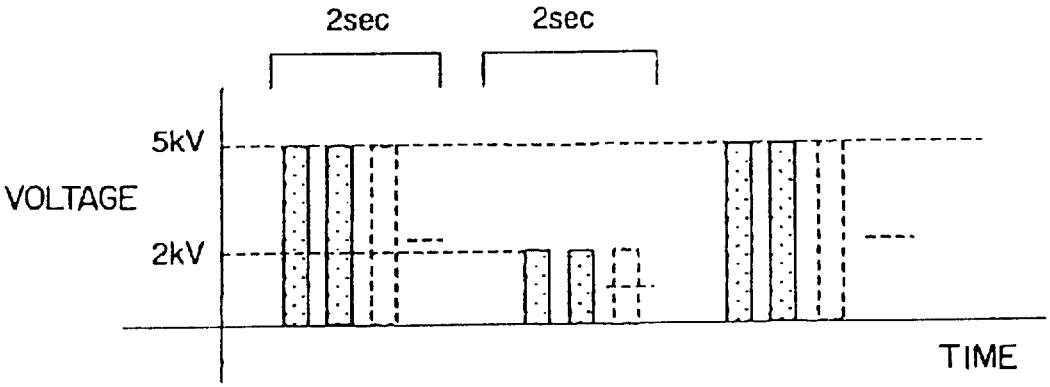
FIG. 13 is a diagram of a voltage pulse signal used by the example shown in FIG. 10.

The frequency and the offset voltage were fixed at 1 kHz and 0 V, respectively, 2 kV amplitude voltage pulses and 5 kV amplitude voltage pulses were applied alternately to the electrode and the mode of discharging the viscous substance was observed. When 2 kV amplitude voltage pulses and 5 kV amplitude voltage pulses were applied alternately to the electrode at periods of 2 seconds as shown in FIG. 13, the viscous substance was discharged in periods where 5 kV voltage pulses were applied to the electrode, and the viscous substance was not discharged in periods where 2 kV voltage pulses were applied to the electrode. However, the meniscus maintained the same shape in both the periods where 2 kV voltage pulses and 5 kV voltage pulses were used.

A description will be given of a method of controlling the timing of discharging the viscous substance through the nozzle by varying conditions for applying voltage to the recording electrode.

Figure 14A:
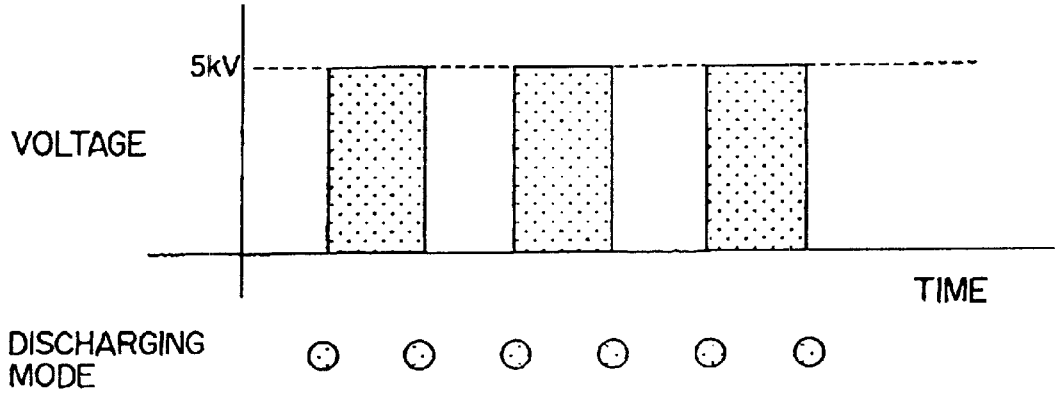
FIGS. 14A, 14B and 14C are diagrams of assistance in explaining the relation between voltage pulse signal applying mode and discharging mode (discharge timing) in the example shown in FIG. 10.
Figure 14B:
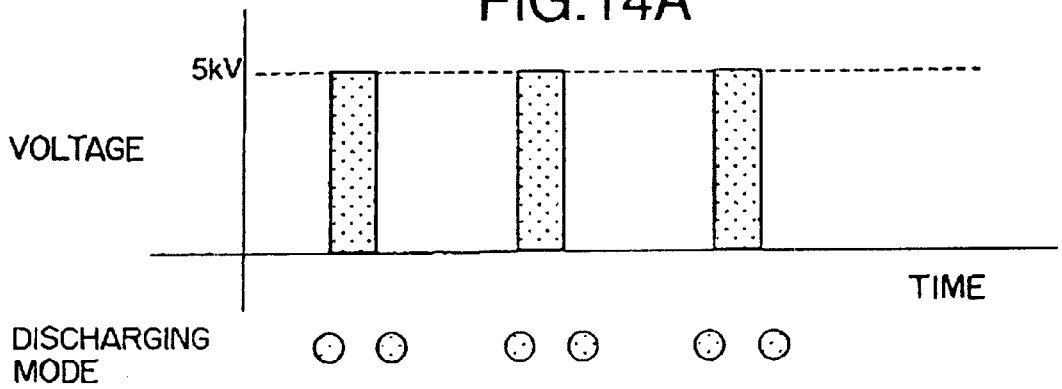
Figure 14C:
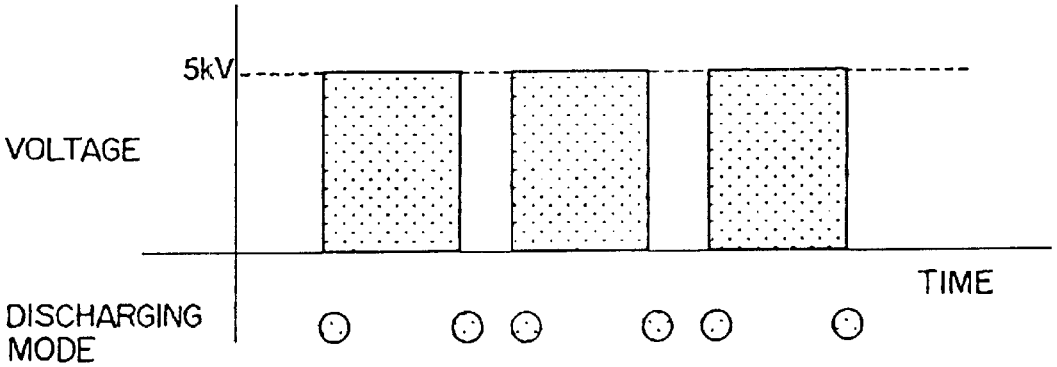

FIGS. 14A, 14B and 14C are diagrams of assistance in explaining the relation between voltage applying conditions and discharging mode.

Referring to FIG. 14A, when a voltage pulses of 0 V-(S kV) are applied to the recording electrode, droplets of the viscous substance are discharged at times corresponding to the leading edge and the trailing edge of each voltage pulse; that is, the droplets of the viscous substance are discharged at a frequency twice that of the voltage pulse signal. Droplets of the viscous substance were discharged in the same mode when the frequency of the voltage pulse signal was varied in the range of 10 Hz to 100 kHz. As shown in FIG. 14B, a voltage pulse signal having rectangular voltage pulses of 0 V–(5 kV) having a small pulse width, and the ratio of the duration of the rectangular voltage pulse and the interval between the rectangular voltage pulses of 1:3 were applied to the recording electrode. Also, as shown in FIG. 14C, a voltage pulse signal having rectangular voltage pulses of 0 V–(5 kV) having a large pulse width, and the ratio of the duration of the rectangular voltage pulse and the interval between the rectangular voltage pulses of 3:1 were applied to the recording electrode. Under these voltage applying conditions, intervals between dots of viscous substance formed in the recording medium were measured. It was found that the dots were formed at intervals corresponding to the ratio of the duration of the rectangular voltage pulse and the interval between the rectangular voltage pulses.

It is known from the forgoing facts that droplets of the viscous substance are discharged at a frequency twice that of the voltage pulse signal when the voltage level of the voltage pulse signal of a rectangular waveform changes.

Figure 15:
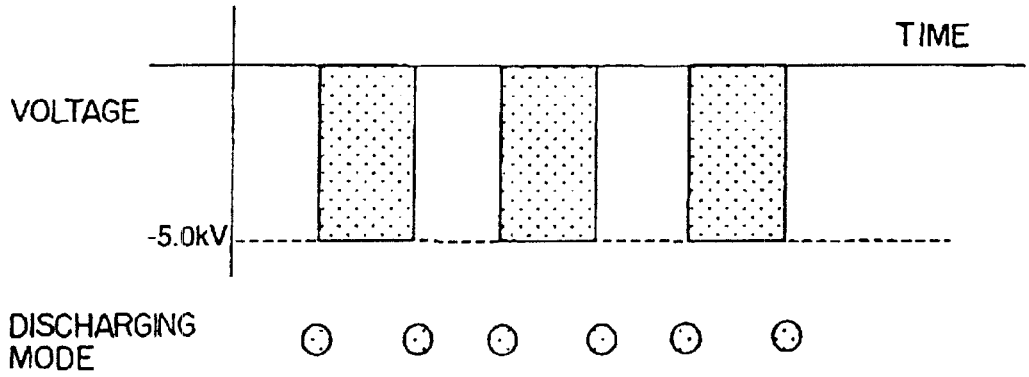
FIGS. 15, 16 and 17 are diagrams of voltage signals to be used by the example shown in FIG. 10.

When the polarity of the voltage pulse signal is inverted to apply a voltage pulse signal having rectangular voltage pulses of 0 V–(−5 kV) as shown in FIG. 15 to the recording electrode, droplets of the viscous substance were discharged at a frequency twice that of the voltage pulse signal in a mode similar to that previously described with reference to FIG. 14A.

Figure 16:
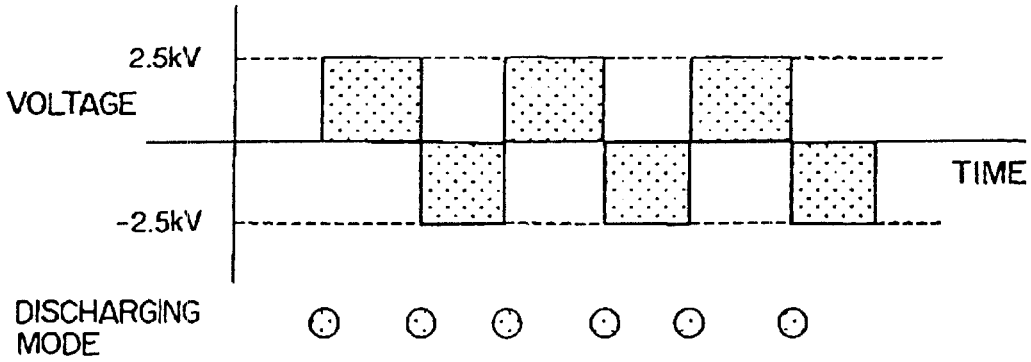

When rectangular voltage pulses of 0 V–(−2.5 kV) and rectangular voltage pulses of 0 V–(+2.5 kV) were applied alternately as shown in FIG. 16 to the recording electrode, droplets of the viscous substance were discharged when the voltage level of the voltage pulse signal changes in a mode similar to those previously described with reference to FIGS. 14A and 15.

Figure 17:
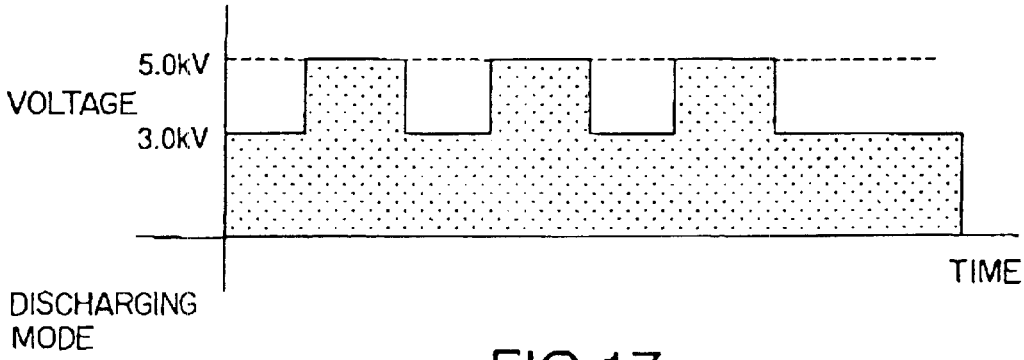

FIG. 17 shows the waveform of a voltage pulse signal having rectangular voltage pulses of (3 kV)–(5 kV) (amplitude: 2 kV) applied to the recording electrode biased at 3 kV. Any droplets of the viscous substance were not discharged when the voltage pulse signal shown in FIG. 17 was applied to the recording electrode. Similarly, any droplets of the viscous substance were not discharged when a fixed voltage of 5 kV was applied to the recording electrode. It was found through similar experiments that droplets of the viscous substance are discharged when the voltage change is 3 kV or above and are not discharged when the voltage change is below 3 kV. The necessary voltage change necessary for discharging droplets of the viscous substance is dependent on the type of the viscous substance. Therefore, the amplitude of the voltage pulses (necessary voltage change) must properly be determined according to the property of the viscous substance.

FIGS. 18 to 21 show modifications of the voltage pulse signal applying modes illustrated in FIGS. 14A, 14B and 14C.

Figure 18:
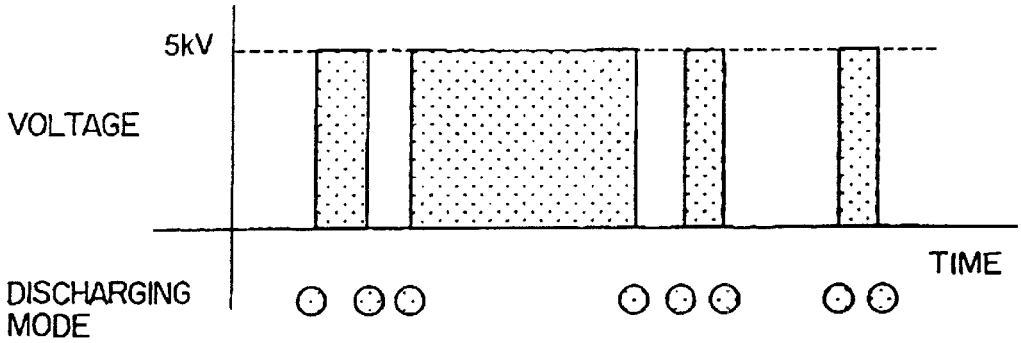
FIG. 18 is a diagram showing a modification of the voltage pulse signal applying modes illustrated in FIGS. 14A to 14C.

FIG. 18 shows a voltage pulse signal having 5 kV amplitude voltage pulses respectively having different pulse widths. It is known from FIG. 18 that droplets of the viscous substance are discharged when the voltage changes and the timing of the droplet discharging operation can be controlled by varying the respective pulse widths of the voltage pulses.

Figure 19:
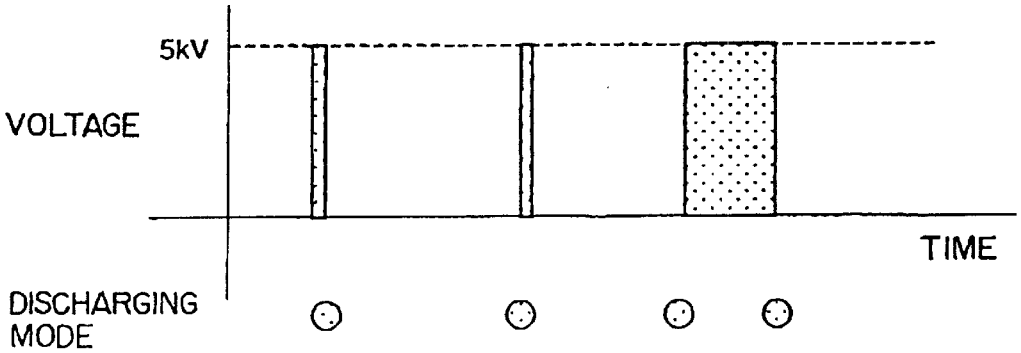
FIG. 19 is a diagram showing a further modification of the voltage pulse signal applying modes illustrated in FIGS. 14A to 14C.

FIG. 19 shows another voltage pulse signal applying mode. As mentioned above, when a voltage signal having rectangular voltage pulses arranged at predetermined intervals is applied to the recording electrode, droplets of the viscous substance are discharged to form dots at times corresponding to the leading edges and the trailing edges of rectangular voltage pulses. A single droplet of the viscous substance can be discharged by a single voltage pulse having a very small pulse width when the pulse width is reduced extremely to a pulse width not greater than a predetermined value so that the droplet discharging operation is unable to follow the voltage pulse signal.

Figure 20:
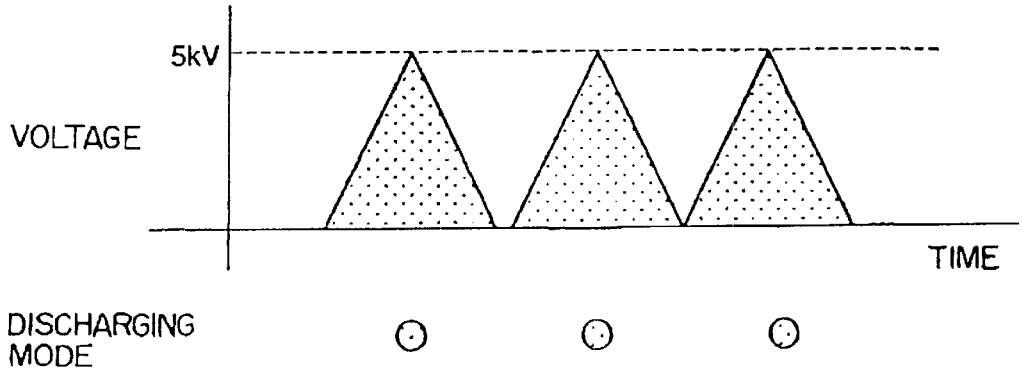
FIG. 20 is a diagram showing a still further modification of the voltage pulse signal applying modes illustrated in FIGS. 14A to 14C.

When a voltage pulse signal having triangular voltage pulses is applied to the recording electrode, a droplet of the viscous substance was discharged at time corresponding to the vertex of each triangular voltage pulse where the voltage starts decreasing as shown in FIG. 20. Thus the timing of the droplet discharging operation can be controlled by a method similar to that described with reference to FIG. 19 by the voltage pulse signal shown in FIG. 20.

Figure 21:
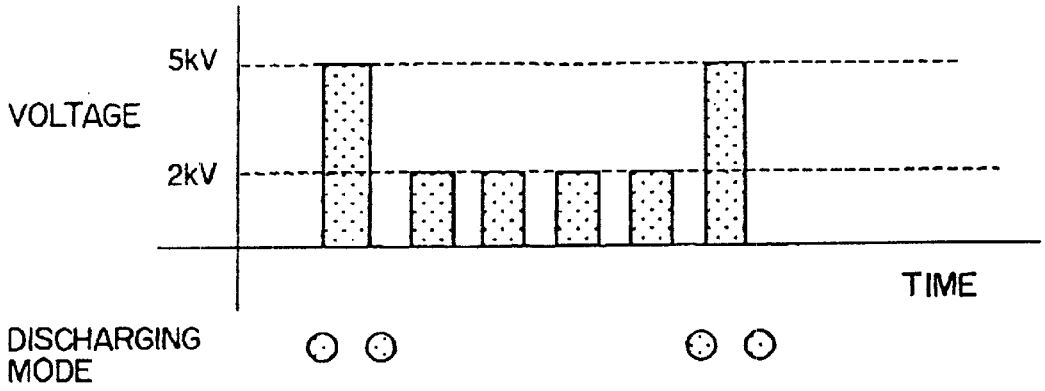
FIG. 21 is a diagram showing a still further modification of the voltage pulse signal applying modes illustrated in FIGS. 14A to 14C.

In the foregoing example, droplets of the viscous substance are discharged only when the voltage change is not smaller than the predetermined value. In some cases, the lengthened portion of the viscous substance contracts and is unable to respond immediately to the change of the voltage when the recording electrode is left unused for a long time with a fixed voltage applied continuously to the recording electrode or with no voltage applied to the recording electrode. The lengthened portion of the viscous substance can be maintained by applying voltage pulses of an amplitude that does not cause discharge as shown in FIG. 21 (2 kV in FIG. 21) to the recording electrode while the discharge of the viscous substance is interrupted. When the lengthened portion of the viscous substance is thus maintained, the lengthened portion is able to respond immediately to the change of the voltage and a droplet of the viscous substance can immediately be discharged when a 5 kV amplitude voltage pulse is applied to the recording electrode.

A description will be given of a method of controlling the discharge of the viscous substance through the nozzle by varying the mode of applying a voltage pulse signal to the recording electrode.

Figure 22:
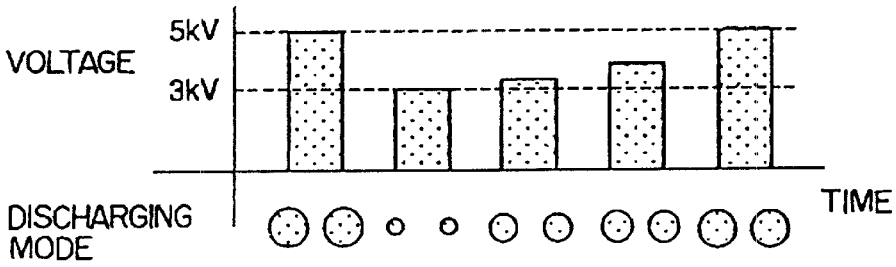
FIG. 22 is a view of assistance in explaining the relation between voltage pulse signal applying mode and discharging mode (discharge timing) in the example shown in FIG. 10.

FIG. 22 is a view of assistance in explaining the relation between voltage pulse signal applying mode and discharging ode.

As shown in FIG. 22, droplets of the viscous substance were discharged when voltage pulses of an amplitude not lower than 3 kV. When the amplitude of the voltage pulses was varied in the range of 3 to 5 kV as shown in FIG. 22, the discharge of the viscous substance varied according to the variation of the amplitude of the voltage pulses. Thus, the discharge of the viscous substance can be controlled through the control of the voltage change of the voltage pulses.

Figure 23:
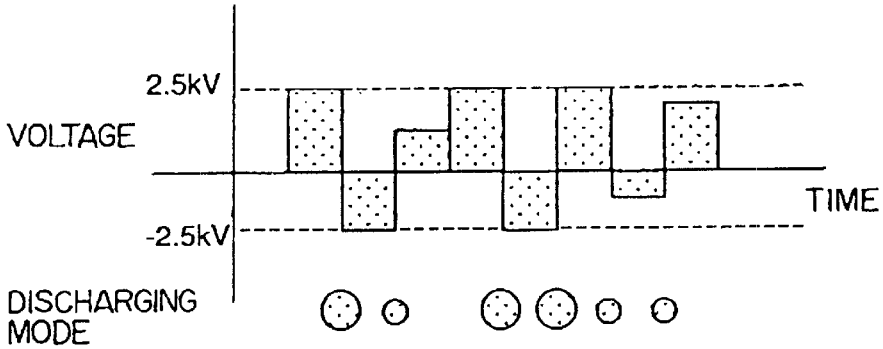
FIG. 23 is a diagram showing a modification of the voltage pulse signal applying mode shown in FIG. 22.
Figure 24:
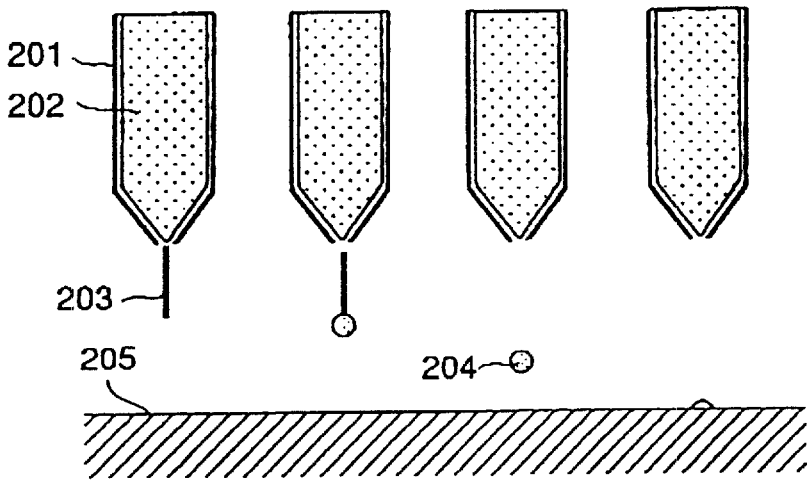
FIG. 24 is a view of assistance in explaining a conventional recording method using a viscous substance.

FIG. 23 shows another mode of voltage pulse application. As shown in FIG. 23, voltage pulses of amplitudes in the range of −2.5 to +2.5 kV were applied to the recording electrode to control the discharge of the viscous substance. Droplets of the viscous substance were not discharged when the voltage change was not higher than 3 kV.

When the pressure applied to the viscous substance contained in the syringe 112 was varied in the range of 0 to 1 atm by the controller 130 shown in FIG. 10 with a voltage pulse signal of a fixed amplitude applied to the recording electrode, the discharge of the viscous substance changed. When the adjustment of the discharge of the viscous substance is not necessary for each voltage pulse of the voltage pulse signal, the adjustment of the discharge of the viscous substance through the adjustment of the back pressure is effective.

The recording apparatus using a viscous substance in this embodiment has: a function to adjust the discharge of the viscous substance through the control of the voltage applied to the recording electrode by the controller 130; and a function to adjust the discharge of the viscous substance to a desired discharge by adjusting the pressure applied to the viscous substance by the controller 130 according to the viscous substance consumption rate. If the viscous substance consumption rate is high, the back pressure applied to the viscous substance is increased to increase the rate of supply of the viscous substance to meet demand for the viscous substance.

The voltage pulses are not limited to rectangular voltage pulses but may be triangular voltage pulses and so on.

The foregoing voltage applying modes are only illustrative and limitative. The conditions for discharging the viscous substance are subject to change according to the viscosity and the surface tension of the viscous substance, the diameter of the orifice and the like.

In this embodiment, the timing of the dot forming operation for forming dots of the viscous substance 111 can be controlled by varying the width or the waveform of the voltage pulses of the voltage pulse signal. Therefore, position where dots are to be formed can be controlled by moving the recording head of the recording apparatus at a fixed speed for scanning and varying the pulse width. Accordingly, the recording apparatus is applicable to forming desired patterns with the viscous substance on recording mediums and to forming characters and images with a recording ink on recording mediums.

What is claimed is:

1. A recording method using a viscous substance, comprising the steps of:

extruding a drop of the viscous substance from an open forward end of a nozzle filled up with the viscous substance;

applying an electric signal corresponding to an image signal to a recording electrode disposed near the open forward end of the nozzle to vibrate the extruded drop of the viscous substance; and attaching a portion of the extruded drop of the viscous substance to a recording medium disposed opposite to the nozzle by separating the portion of the extruded drop of the viscous substance from the extruded drop of the viscous substance.

2. The recording method according to claim 1, further comprising the step of applying a pressure to the viscous substance filling up the nozzle in synchronism with the application of the electric signal to the recording electrode.

3. The recording method according to claim 1, further comprising the step of heating the extruded drop of the viscous substance extruded from the open forward end of the nozzle.

4. The recording method according to claim 1, further comprising the step of curing the viscous substance adhering to the recording medium with ultraviolet rays.

5. The recording method according to claim 1, wherein the viscous substance has thixotropy.

6. The recording method according to claim 1, wherein the viscous substance has a viscosity of 300 cP or above.

7. The recording method according to claim 1, wherein the viscous substance meets a condition expressed by:

$$\eta_1 \geqq 300 \text{ cP; and}$$

$$\eta_1 \geqq \eta_2,$$

where $\eta_1$ is an apparent viscosity at a shear rate of 0.1 (l/s) and $\eta_2$ is an apparent viscosity at a shear rate of 100 (l/s).

8. The recording method according to claim 1, wherein the electric signal used in the step of applying the electric signal is a voltage pulse signal having a plurality of voltage pulses.

9. The recording method according to claim 8, wherein timing of an operation for discharging droplets of the viscous substance is controlled by controlling a pulse width of the voltage pulses of the voltage pulse signal.

10. The recording method according to claim 9, wherein the viscous substance is discharged at times corresponding to a leading and a trailing edge of the voltage pulses.

11. The recording method according to claim 9, wherein the viscous substance is discharged at a frequency twice that of the voltage pulse signal.

12. The recording method according to claim 9, wherein the pulse width of the voltage pulses is adjusted to a value not greater than a predetermined value to discharge the viscous substance at a frequency equal to that of the voltage pulse signal.

13. The recording method according to claim 9, wherein the voltage pulses of the voltage pulse signal are rectangular or triangular voltage pulses.

14. The recording method according to claim 9, wherein an amplitude of the voltage pulses of the voltage pulse signal is adjusted to a value not greater than a predetermined value to interrupt the discharge of the viscous substance.

15. The recording method according to claim 8, wherein discharge amount of the viscous substance is controlled by controlling an amplitude of the voltage pulses of the voltage pulse signal.

16. The recording method according to claim 15, wherein the discharge amount of the viscous substance is controlled by controlling a pressure to be applied to the viscous substance contained in the nozzle.

17. The recording method according to claim 1, wherein the nozzle and the recording medium are moved relative to each other.

18. The recording method according to claim 1, wherein a plurality of portions of the extruded drop of the viscous substance are caused to fly successively in droplets with the nozzle and the recording medium being held stationary.

19. A dot structure formed by the recording method according to claim 1, wherein the dot structure has a plurality of dots having diameters in the range of 1 to 300 $\mu$m, and aspect ratios in the range of 0.33 to 20.

20. A recording apparatus using a viscous substance, comprising:

a nozzle filled up with the viscous substance;

a recording electrode disposed near an open forward end of the nozzle; and an electric signal applying unit for applying an electric signal corresponding to an image signal to the recording electrode to vibrate a drop of the viscous substance extruded from the open forward end of the nozzle.

21. The recording apparatus according to claim 20, wherein the nozzle is formed of an electrically nonconducting material.

22. The recording apparatus according to claim 20, wherein the recording electrode is disposed on an outer surface of a wall of the nozzle.

23. The recording apparatus according to claim 20, wherein the nozzle has a metallic portion serving as the recording electrode.

24. The recording apparatus according to claim 20, further comprising a first pressure device for applying a pressure to the viscous substance filling the nozzle so as to urge the viscous substance from the side of a rear end of the nozzle toward the side of the forward end of the nozzle.

25. The recording apparatus according to claim 20, further comprising a second pressure device for applying a pressure to the viscous substance filling the nozzle in synchronism with the application of the electric signal to the recording electrode.

26. The recording apparatus according to claim 20, wherein the distance between the forward end of the nozzle and a recording medium disposed opposite to the forward end of the nozzle is in the range of 0.1 to 10 mm.

27. The recording apparatus according to claim 20, further comprising a heating unit for heating the drop of the viscous substance extruded from the forward end of the nozzle.

28. The recording apparatus according to claim 20, further comprising an ultraviolet ray emitting unit for curing viscous substance adhering to a recording medium disposed opposite to the forward end of the nozzle.

29. The recording apparatus according to claim 20, wherein the electric signal is a voltage pulse signal having a plurality of voltage pulses, and the electric signal applying unit controls timing of an operation for discharging droplets of the viscous substance by controlling a pulse width of the voltage pulses of the voltage pulse signal.

30. The recording apparatus according to claim 20, wherein the electric signal is a voltage pulse signal having a plurality of voltage pulses, and the electric signal applying unit controls a discharge amount of the viscous substance by controlling an amplitude of the voltage pulses of the voltage pulse signal.

31. The recording apparatus according to claim 30, further comprising a first pressure device for applying a pressure to the viscous substance filling the nozzle so as to urge the viscous substance from the side of a rear end of the nozzle toward the side of the forward end of the nozzle, and the electric signal applying unit controls a discharge amount of the viscous substance by controlling the pressure to be applied by the first pressure device to the viscous substance.

* * * * *